US009462369B2

(12) United States Patent
Kalhok

(10) Patent No.: US 9,462,369 B2
(45) Date of Patent: Oct. 4, 2016

(54) AMBIENT AND AUDIO EARPHONE SYSTEM

(71) Applicant: GRITWORKS, INC., Carbondale, IL (US)

(72) Inventor: David Kalhok, Carbondale, IL (US)

( * ) Notice: Subject to any disclaimer, the term of this patent is extended or adjusted under 35 U.S.C. 154(b) by 132 days.

(21) Appl. No.: 14/554,438

(22) Filed: Nov. 26, 2014

(65) Prior Publication Data

US 2015/0146908 A1 May 28, 2015

Related U.S. Application Data

(60) Provisional application No. 61/909,305, filed on Nov. 26, 2013.

(51) Int. Cl.
*H04R 1/10* (2006.01)

(52) U.S. Cl.
CPC ..... *H04R 1/1058* (2013.01); *H04R 1/1033* (2013.01); *H04R 1/1041* (2013.01); *H04R 2420/09* (2013.01)

(58) Field of Classification Search
CPC ..... Y10S 24/13; Y10S 24/16; Y10S 24/28; Y10S 24/30–24/51; Y10S 24/905–24/907; Y10S 2/905–2/906; H04R 1/1066; H04R 1/1083; H04R 1/1075; H04R 5/0335
USPC ..... 381/309, 301, 370–385; 181/128, 129, 181/130, 135
See application file for complete search history.

(56) References Cited

U.S. PATENT DOCUMENTS

| | | | | |
|---|---|---|---|---|
| 1,983,928 | A * | 12/1934 | Brown | H04R 25/04 174/70 R |
| 4,993,065 | A * | 2/1991 | Chiou | H04M 1/05 379/430 |
| 6,707,924 | B1 * | 3/2004 | Okiebisu | A45F 5/00 181/128 |
| D686,189 | S * | 7/2013 | Lu | D14/205 |
| 8,652,062 | B1 * | 2/2014 | Holder | A61B 5/7405 600/508 |
| 8,761,430 | B2 * | 6/2014 | Zimmerman | H04R 1/1033 381/374 |
| 9,055,795 | B2 * | 6/2015 | Larkin | A45C 11/00 |
| 2007/0021073 | A1 * | 1/2007 | Gratton | H04M 1/05 455/90.2 |
| 2007/0053523 | A1 * | 3/2007 | Iuliis | A45F 5/00 381/77 |

* cited by examiner

*Primary Examiner* — Davetta W Goins
*Assistant Examiner* — Jasmine Pritchard
(74) *Attorney, Agent, or Firm* — Polsinelli PC

(57) ABSTRACT

An ambient and audio earphone system having a right-side earbud and a left-side earbud operatively connected to a detachable electronic clasp that is in communication with an electronic pendant for controlling the operation of the ambient and audio earphone system.

16 Claims, 7 Drawing Sheets

AMBIENT AND AUDIO EARPHONE SYSTEM

CROSS REFERENCE TO RELATED APPLICATIONS

This application claims benefit to U.S. provisional patent application Ser. No. 61/909,305 filed on Nov. 26, 2013, which is herein incorporated by reference in its entirety.

FIELD

The present document relates to an earphone system and in particular to an ambient and audio earphone system with a detachable clasp component.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
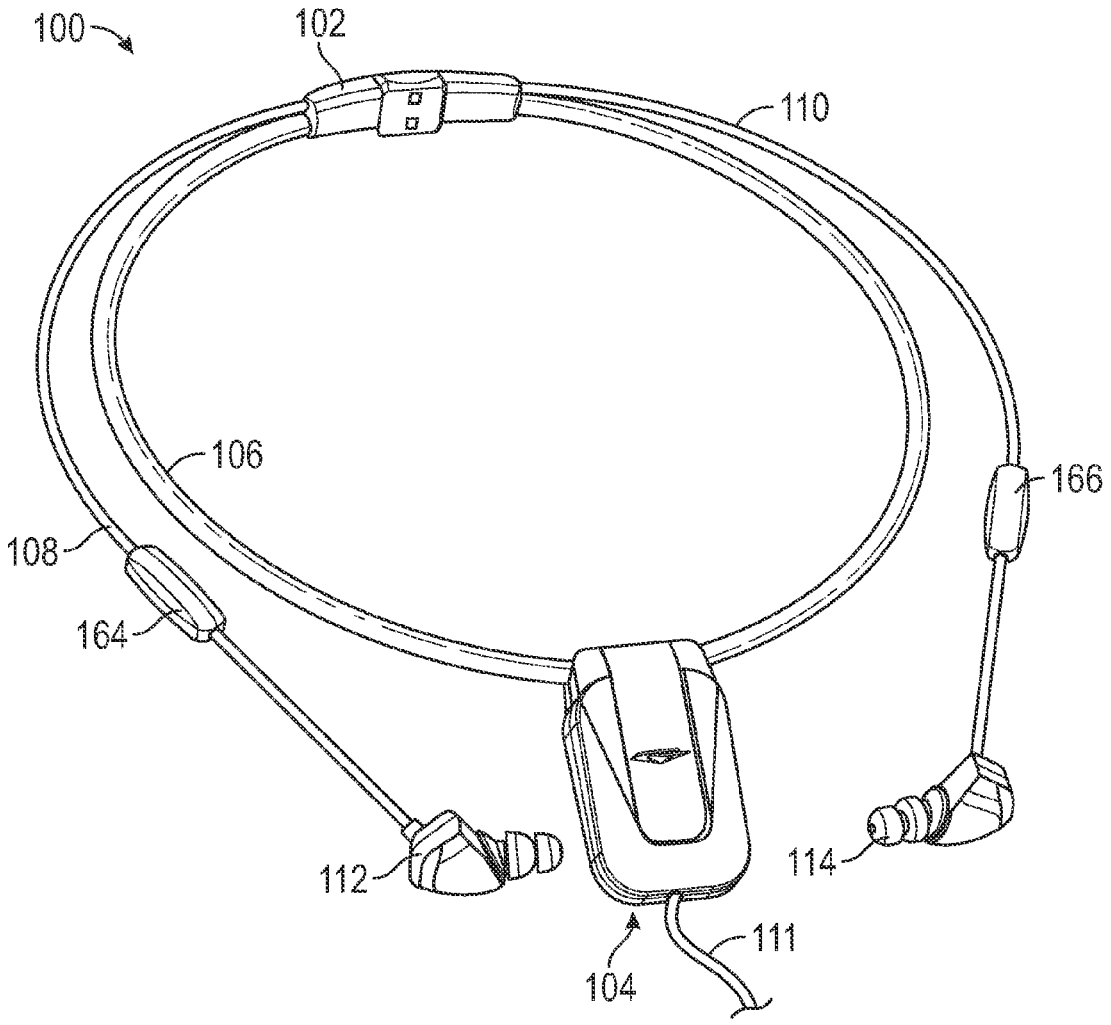
FIG. 1 is a perspective view of a first embodiment of an earphone system showing first and second earbuds, an electronic clasp, and an electronic pendant of the earphone system.

Embodiments of an ambient and audio earphone system having a left-side earbud and a right-side earbud that are electronically connected to a pendant through an electronic clasp that may be connected or disconnected for providing operation of the ambient and audio earphone system are disclosed herein. Referring to the drawings, embodiments of an earphone system are generally designated 100, 200 and 300 is illustrated in FIG. 1-10.

As shown in FIG. 1, in some embodiments the earphone system 100 includes an electronic clasp 102 that is operatively connected to a first earbud 112 through a first cable 108 and a second earbud 114 through a second cable 110. In addition, the electronic clasp 102 is also operatively connected to an electronic pendent 104 through a necklace cable 106 for providing power to the electronic pendent 104 through the electronic clasp 102 as well as transmitting audio signals to the first and second earbuds 112 and 114. In addition, the earphone system 100 may further include first and second microphones 164 and 166 operatively connected to the first cable 108 and second cable 110, respectively, to provide true stereo ambient or stereo-like sound through the left and right earbuds 112 and 114. In other embodiments, a single microphone, for example microphone 164 or 166 to provide mono ambient sound through the first and second earbuds 112 and 114.

In some embodiments, the first and second earbuds 112 and 114 are designed to provide acoustic sealing and close proximity to the speaker/driver (not shown) in each of the first and second earbuds 112 and 114 relative to the individual's eardrum. This arrangement results in a lower volume of air in the ear canal of the individual when the first and second earbuds 112 and 114 are inserted therein, which generates less acoustical pressure at the speaker/driver of each of the first and second earbuds 112 and 114 for a given perceived volume by the earphone system 100. This greater mechanical and acoustic efficiency translates into less electrical energy being required to drive the speaker of each of the first and second earbuds 112 and 114. This greater efficiency means less energy is consumed by the earphone system 100 to produce the same listening experience as conventional earphone systems.

In one embodiment, the electronic pendent 104 is wirelessly connected to an audio source (not shown), such as a conventional stereo receiver or mobile device, in which the electronic pendent 104 is in operative communication with a wireless antenna (not shown) for providing wireless signals from a sound system. In another embodiment, the electronic pendent 104 may be hard wired directly to such audio sources. The electronic pendent 104 includes a user interface, such as buttons or controls, for the individual to operate the earphone system 100 for example by pinching the buttons or controls between the thumb and any one of the fingers of the same hand. As such, activation of the electronic pendent 104 does not require actual sight of the user interface by the individual since the user interface may include tactile momentary switches that provide physical feedback to the individual when the button is activated, while in some embodiments the user interface may include capacitive touch controls that provide a tactile feel to the individual during operation or controlled using a non-tactile functionality, such as an audio sound. In some embodiments, activation of a particular button on the electronic pendent 104 may be signaled to the individual through an audible alert through the first and second earbuds 112 and 114. In some embodiments, the electronic pendent 104 may include a rechargeable internal pouch or a prismatic cell may be used to provide power to the earphone system 100, although in other embodiments, non-rechargeable battery options may be used.

Figure 2:
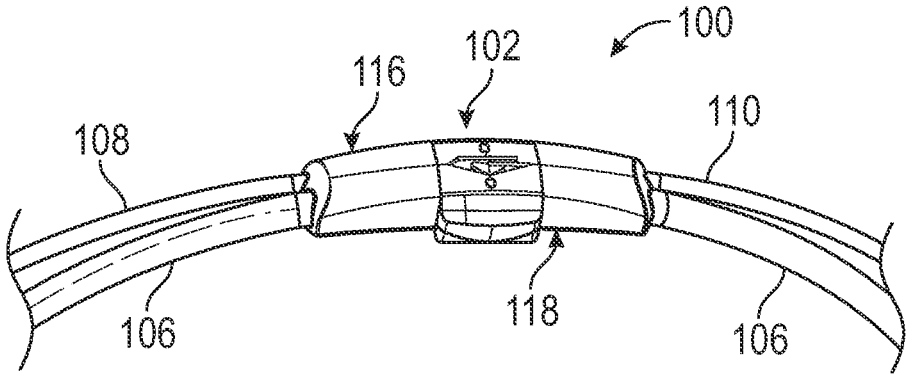
FIG. 2 is an enlarged perspective view of the electronic clasp having a first clasp portion and second clasp portion shown in the engaged position.
Figure 3:
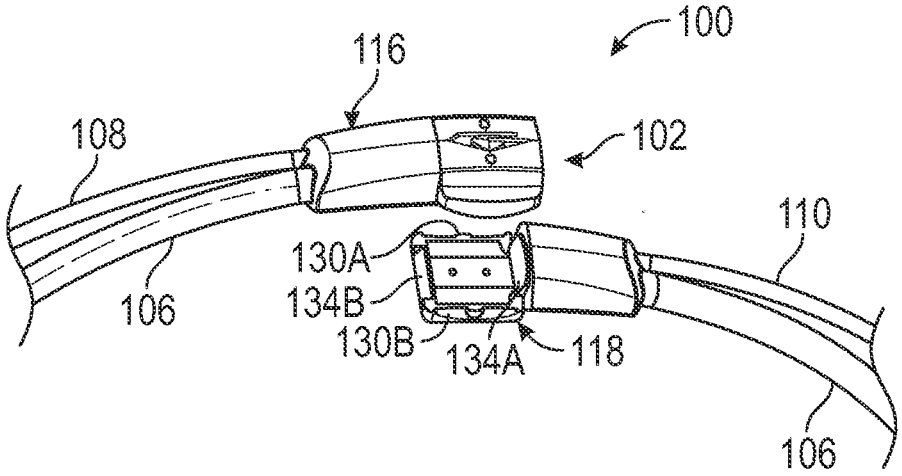
FIG. 3 is an enlarged perspective view of the electronic clasp with the first clasp portion and the second clasp portion shown in the disengaged position.

In some embodiments the electronic clasp 102 may be a universal USB Type A slim connector for charging the electronic pendent 104. The electronic clasp 102 functions as a detachable junction in which all the wiring for the earphone system 100 is routed. Referring to FIGS. 2 and 3, the electronic clasp 102 has a magnetic quick release feature that provides a self-locating, safety break-away that permits the earphone system 100 to be operable when the electronic clasp 102 is an attached state (FIG. 2) and inoperative when the electronic clasp 102 is in a detached state (FIG. 3).

Figure 4:
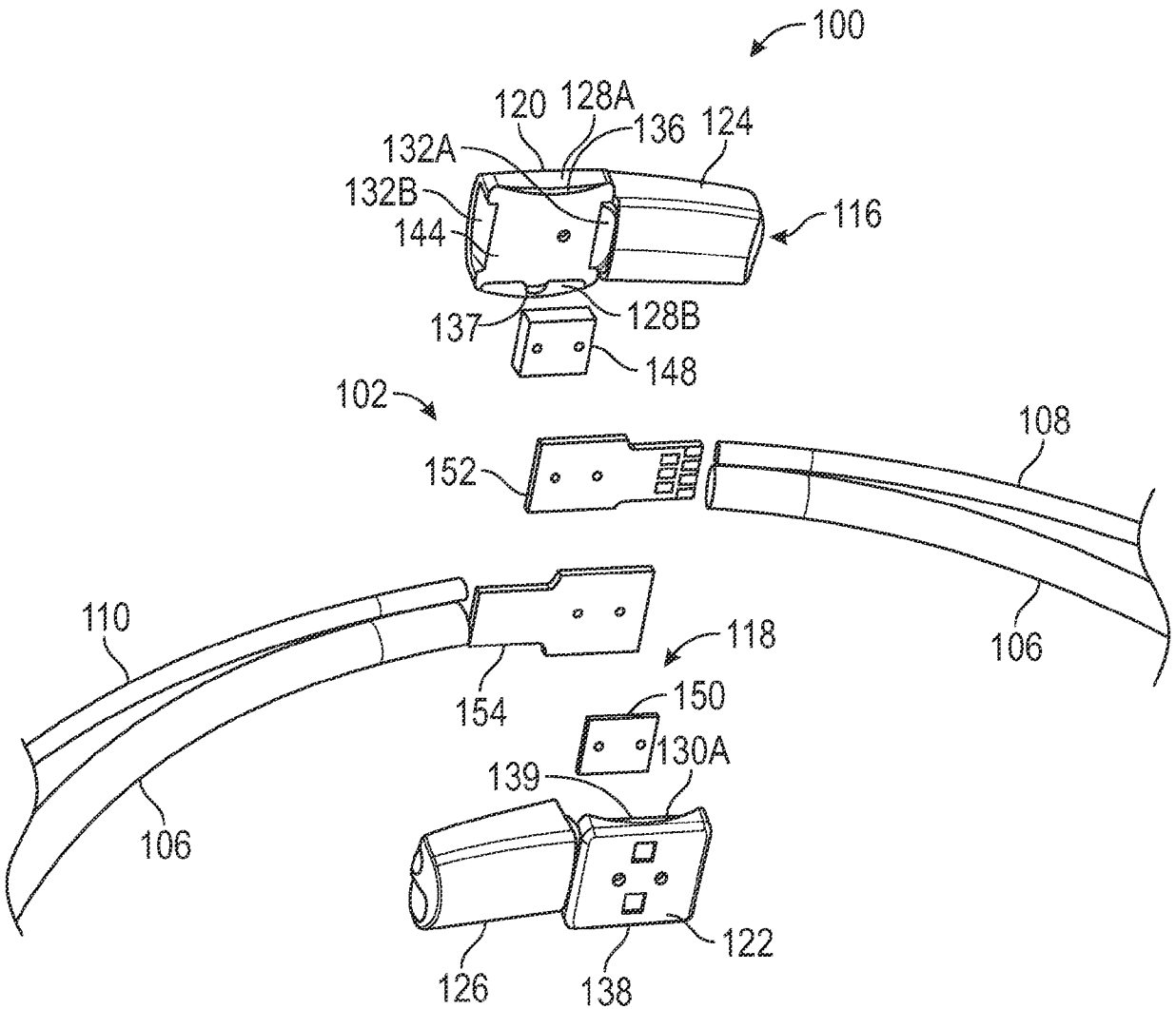
FIG. 4 is a bottom exploded view of the electronic clasp.
Figure 5:
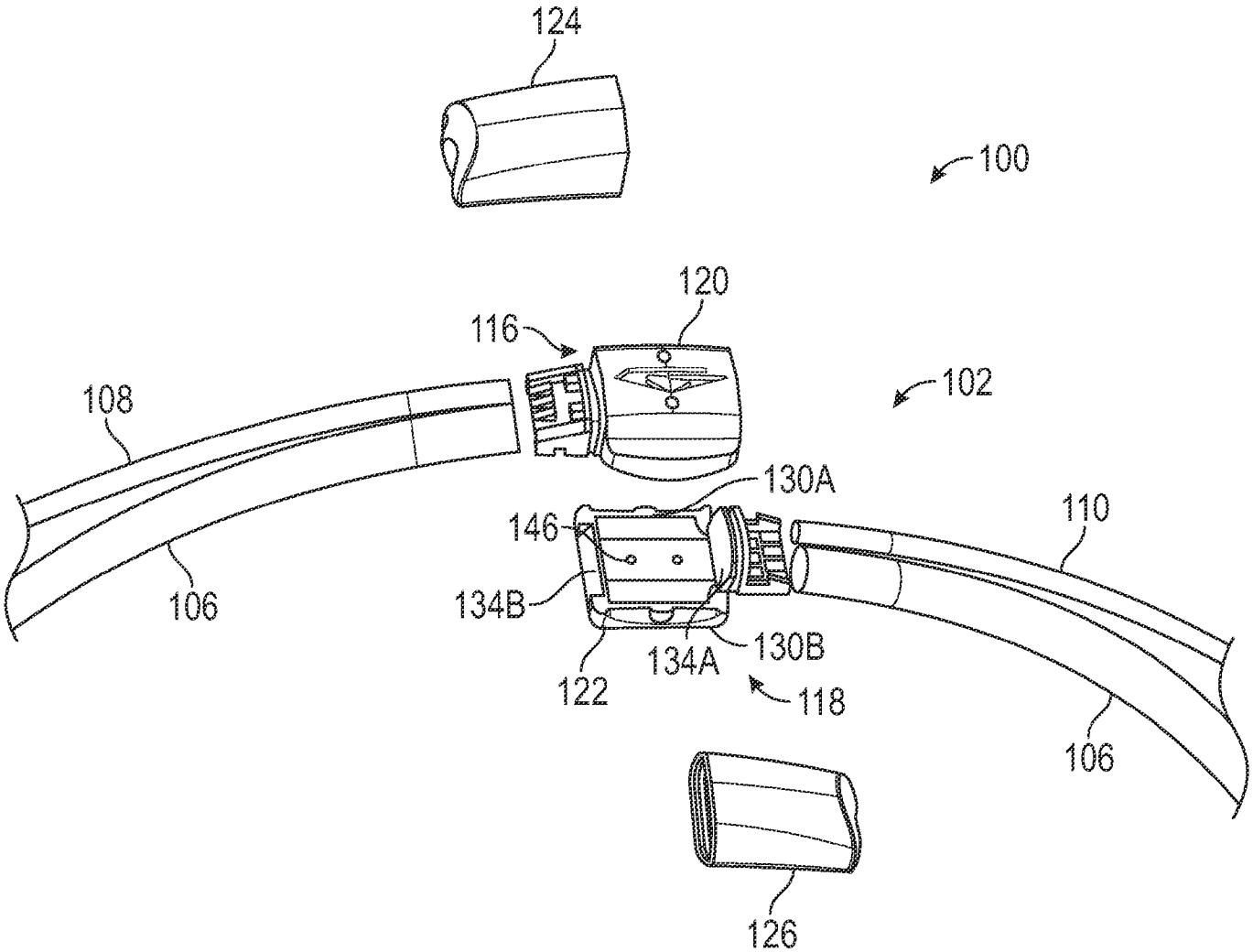
FIG. 5 is a top exploded view of the electronic clasp.
Figure 6:
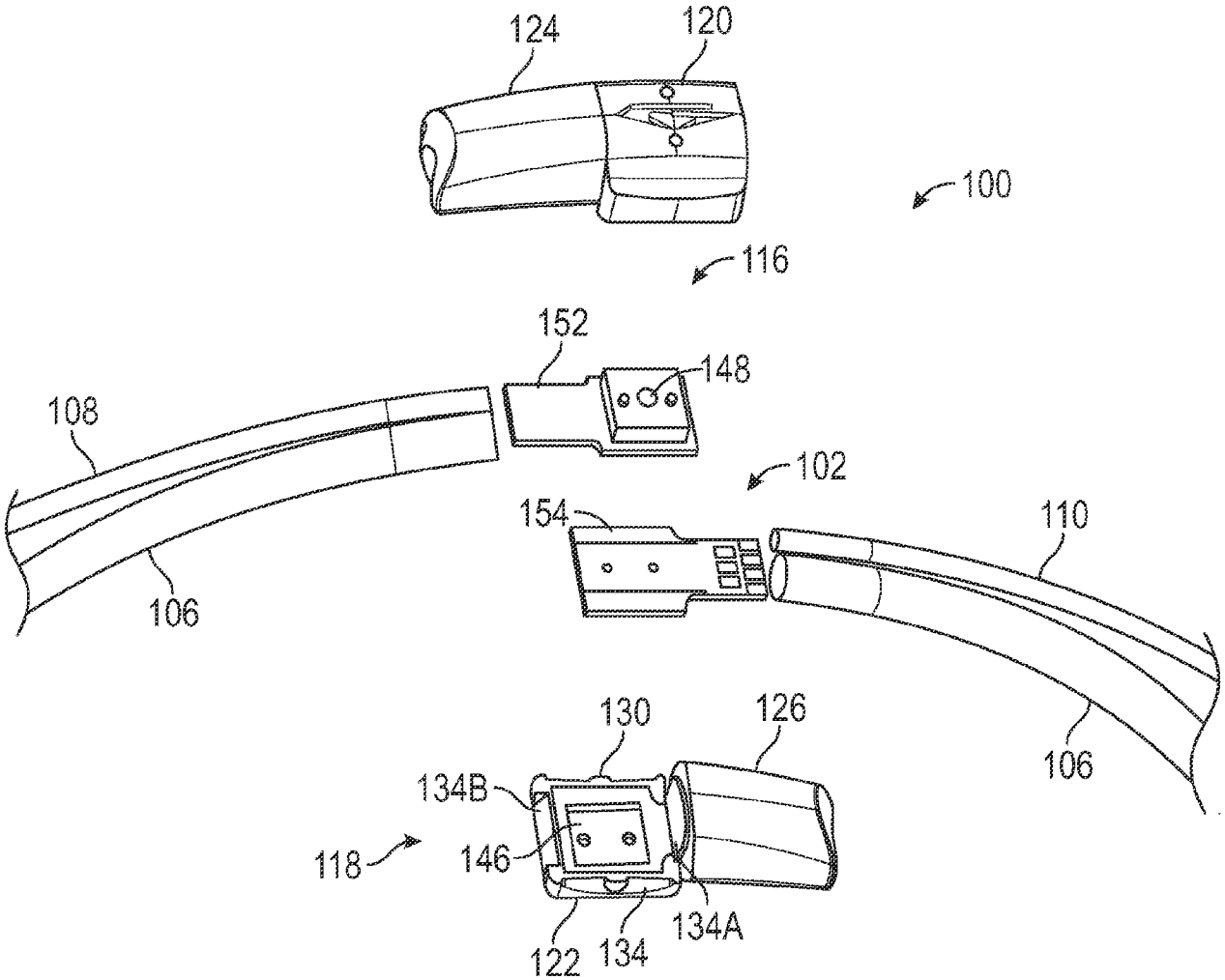
FIG. 6 is another top exploded view of the electronic clasp.

Referring to FIGS. 4-6, the electronic clasp 102 includes a first clasp portion 116 that is detachable engaged to a second clasp portion 118. In some embodiments, the first clasp portion 116 includes a first center section 120 connected to a first strain relief 124 that encases the portion of the necklace 106 and first cable 108 secured to the first center section 120. Similarly, in some embodiments the second clasp portion 118 includes a second center section 122 connected to a second strain relief 126 that encases the portion of the necklace 106 and second cable 110 secured to the second center section 122. In some embodiments, the first and second strain reliefs 124 and 126 are made of a flexible material that allows each one to flex in response to stress forces applied to the first clasp portion 116 and second clasp portion 118, respectively.

Figure 10:
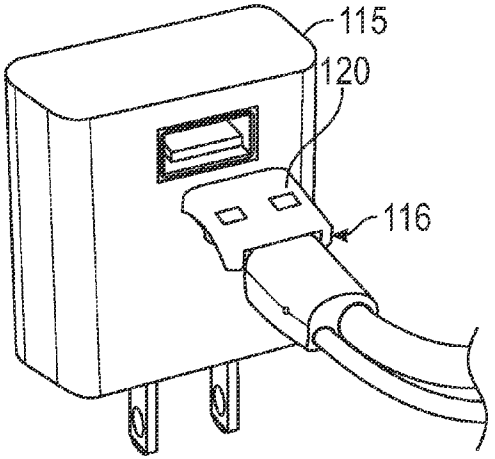
FIG. 10 is a perspective view of the first clasp portion operatively engaged to a charger unit.

In some embodiments, the electronic clasp 102 can serve independently as a charging connection or data transfer connection, or serve both functions. As shown in FIG. 10, the first clasp portion 116 may be detached from the second clasp portion 118 so that the first center section 120 may be operatively engaged with a conventional charger for charging the battery of the earphone system 100.

In some embodiments of the electronic clasp 102, the first center section 120 may be configured to be detachably connected to the second center section 122 utilizing several means of connection. Referring to FIGS. 4 and 6, the first center section 120 may define a substantially square-shaped recess 144 configured to receive a first magnet 148 therein, while the second center section 122 may define a similarly shaped second recess 146 configured to receive a second magnet 150 therein. In one arrangement, the first and second magnets 148 and 150 generate an attracting magnetic force when the first clasp portion 116 is attached to the second clasp portion 118. In addition to providing an attachment function, the first and second magnets 148 and 150 also allow the first clasp portion 116 to be aligned with the second clasp portion 118 using the attractive magnetic force of the first and second magnets 148 and 150 to guide both clasp portions 116 and 118 together, thereby providing a self-closing function to the electronic clasp 102.

As further shown in FIG. 4, the first center section 120 defines a pair of opposing first mechanical interlocking members 128A and 128B, while the second center section 122 defines a similar pair of opposing second mechanical interlocking members 130A and 130B. In particular, the first mechanical interlocking member 128A defines an outwardly extending tab 136 and the first mechanical interlocking member 128B defines a notch 137. Similarly, the second mechanical interlocking member 130A defines an outwardly extending tab 138 and the second mechanical interlocking member 130B defines a notch 139.

In one embodiment, the notch 137 of the first center section 120 and the notch 139 of the second center section 122 each form a vertical or negative angle relative to the respective first center section 120 and second center section 122, respectively, in which the first and second notches 137 and 139 are configured to interlock or engage with the corresponding outwardly extending tabs 136 and 138 when securing the first clasp portion 116 with the second clasp portion 118. For example, the outwardly extending tab 136 of the first center portion 120 may be configured to engage the notch 139 of the second center portion 122, while the outwardly extending tab 138 of the second center portion 122 may be configured to engage the notch 137 of the first center portion 120. In this arrangement, a mechanical "click" interlock or snap-fit connection is produced when the first clasp portion 116 is attached to the second clasp portion 118 such that a safety release function is activated when sufficient force is applied to the first clasp portion 116 and/or second clasp portion 118. In some embodiments, the pair of first interlocking members 128A, 128B and pair of second interlocking members 130A, 130B may be made from a resilient deformable material that allows for the mechanical "click" interlock or snap-fit connection between the first and second center sections 120 and 122.

In some embodiments, the factors affecting the interlock strength between the first and second center sections 120 and 122 may be 1) angle of the notches 137 and 139 along the first and second mechanical interlocking members 128B and 130B; 2) depth and profile of the tabs 136 and 138 along first and second interlocking members 128A and 130A; and 3) the hardness and flexibility of the material for the first and second center sections 120 and 122.

In some embodiments, notches 137 and 139 may both be defined on the first center section 120, while tabs 136 and 138 may both be defined on the opposite second center section 122, or vice versa. In some embodiments, the first and second mechanical interlocking members 128A, 128B, 130A and 130B may be made from a flexible or deformable material that permits the outwardly extending tabs 136 and 138 to snap into position within respective notches 137 and 139 when producing the mechanical "click" interlock between the first and second center sections 120 and 122.

As further shown in FIGS. 4 and 5, the first center section 120 further defines a male locator ramp 132A and an opposing female locator ramp 132B, while the second center section 122 defines a similarly shaped male locator ramp 134A and opposing female locator ramp 134B. In one arrangement, when the first and second clasp portions 116 and 118 are secured together the female locator ramp 132B of the first center section 120 acts as a guide to the male locator ramp 134A of the second center section 122. Similarly, the female locator ramp 134B of the second center section 122 also acts as a guide to the male locator ramp 132A of the first center section 120. In addition, the male locator ramps 132A, 134A and the female locator ramps 132B and 134B aid in retention strength when the first clasp portion 116 is secured to the second clasp portion 118.

In some embodiments, the first clasp portion 116 includes a first printed circuit board (PCB) 152 connected to the first center section 120 and the second clasp portion 118 includes a second printed circuit board (PCB) 154 that is connected to the second center portion 122. The first and second PCBs 152 and 154 each serve as the respective main connection juncture for all the wiring disposed within the electronic clasp 102. In other embodiments, the first and second PCBs 152 and 154 may be a transfer point where multiple wires (not shown) are joined as a pass-through connection, such as for microphone speaker and/or data connections. In some embodiments, the first and second PCB s 152 and 154 may include USB power contacts for charging the earphone system 100 or USB data contacts for transmission of data signals, such as audio signals, to the first and second earbuds 112 and 114. In some embodiments, the first and second PCBs 152 and 154 may include different arrangements, such as USB power contacts that form an outer contact arrangement and USB data contacts that form an inner contact arrangement, or vice versa. In some embodiments, the first and second PCBs 152 and 154 may include USB power contacts and/or USB data contacts.

Figure 7:
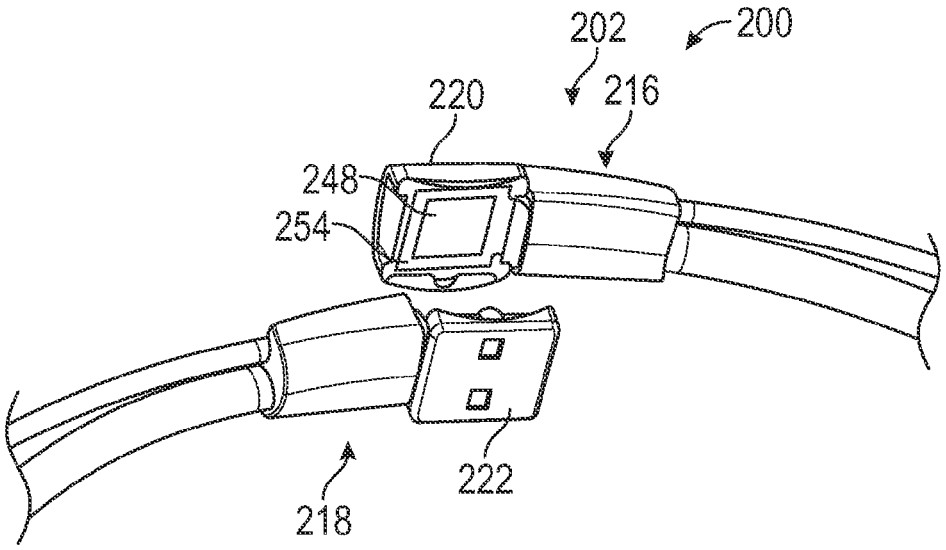
FIG. 7 is a perspective view of another embodiment of the electronic clasp having an exposed first magnet.

Referring to FIG. 7, a second embodiment of the earphone system, designated 200, is illustrated. In this embodiment, the electronic clasp 202 includes a first clasp portion 216 and a second clasp portion 218 that may be attached and detached in the same manner as the electronic clasp 102. However, in this embodiment, for example, the first clasp portion 216 includes a first center section 220 that is configured to have a first magnet 248 and a first printed circuit board 254 that are both exposed when connected to the first center section 220 rather than recessed like the first magnet 148 for the electronic clasp 102. Similarly, the second clasp portion 218 is configured in similar fashion as the first clasp portion 216 in which a second magnet and second printed circuit board (not shown) are also exposed when engaged to the second center section 222. The advantage of the exposed arrangement is that the first magnet 248, for example, can be as close as possible to the second magnet engaged to the second clasp portion 218, which equates to a stronger magnetic attraction force between the first and second clasp portions 216 and 218. In addition, the first magnet 248 may be thicker than if the first magnet 248 were recessed within the first center section 220.

Figure 8:
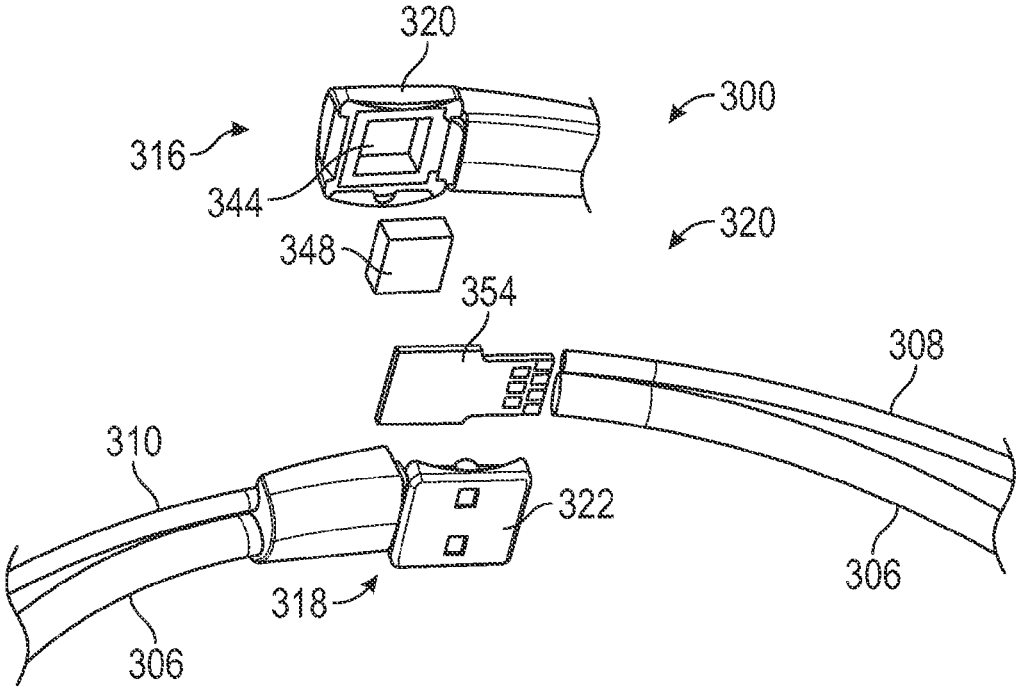
FIG. 8 is a perspective view of a third embodiment of the electronic clasp having a hidden first magnet.

Referring to FIG. 8, a third embodiment of the earphone system, designated 300, is illustrated. In this embodiment, the electronic clasp 302 includes a first clasp portion 316 and a second clasp portion 318 that may be attached and detached in the same manner as the electronic clasp 106. As shown, a first cable 308 and a necklace cable 306 are operatively engaged to the first clasp portion 316, while a second cable 310 and the necklace cable 306 are operatively engaged to the second clasp portion 318. However, in this embodiment, for example, the first center section 320 defines a recess 344 configured to receive a first magnet 348 therein such that the first printed circuit board 354 encases the first magnet 348 within the recess 344 when the first clasp portion is assembled. Similarly, the second clasp portion 318 is assembled in similar fashion such that the second magnet (not shown) is disposed within a second recess (not shown) of the second center section 322 such that a second printed circuit board (not shown) encases the second magnet within the second recess.

In some embodiments, the first and second cables 108 and 110 provide a means for charging a battery (not shown) disposed within the electronic pendent 104 that provides power to the earphone system 100. In addition, the first and second cables 108 and 110 provide a conduit for the microphone cables (not shown) and wires (not shown) for providing clear audio signals to the left and right drivers (not shown) associated with the first and second earbuds 112 and 114, respectively. In some embodiments, the first and second cables 108 and 110 may include a shielding function to prevent electromagnetic interference that interferes with either the audio or microphone signals.

In some embodiments as shown in FIG. 1, a cable 111 may extend from the electronic pendent 104 to an external device (not shown), such as an Iphone, which is either detachable with the cable 111 via a wireless connector (not shown) or hard wired directly with the external device. In some embodiments, the cable 111 exits from the bottom portion of the electronic pendent 104 so as to keep earphone system 100 relatively stable when in use.

As shown in FIG. 1, the earphone system 100 includes first microphone 164, which is positioned along the first cable 108 and a second microphone 166, which is positioned along the second cable 110 that collectively provide stereo ambient sound and capability. In some embodiments, the earphone system 100 may include one or both first and second microphones 164 and 166.

In some embodiments, first and second microphones 164 and 166 are hooked up in parallel along the first and second cables 108 and 110, respectively, as a single mono circuit, but due to the distance between the first and second microphones 164 and 166, a stereo-like effect may still heard by the user as there is a timing difference when sound hits each microphone 164 and 166 and then transferred to the user's ears via the AMBi application on the user's device. This arrangement allows the first and second microphones 164 and 166 to be located (cinche up) behind user's head to reduce wind noise by getting the first and second microphones 164 and 166 out of direct contact with the wind stream, such as when running or riding a device such as a bicycle or motorcycle. In addition, the first and second microphones 164 and 166 are not covered up when user wears a helmet or hat that can increase noise through friction/rubbing, sound amplification (as inside a helmet) or inhibit the ability of either the first or second microphones 164 and 166 to pick up sound simply by being covered up.

As further shown in FIG. 1, the first and second earbuds 112 and 114 each have an overall geometry that applies no pressure points within the ear when disposed therein. Specifically, instead of relying on clips, clamps, wedges or plugs, the first and second earbuds 112 and 114 conform and capitalize on your ear's natural shapes and geometry to result in an earbud that finally feels like it was meant to be in your ear, especially after long periods of use. This unique fit of the first and second earbuds 112 and 114 makes them inherently stable, balanced and extremely resistant to accidently fall out, even if something is pulling down on the cables. The overall geometry of the first and second earbuds 112 and 114 minimizes or eliminates any requirement that the eartips function to retain each earbud 112 and 114 in the ear. In typical earbud designs, the eartip serves to both seal the ear and be the primary or sole method of retaining the earbud in the ear. This double function thus requires that typical eartips fit in the ear with greater pressure which leads to discomfort for the user. The eartips of the first and second earbuds 112 and 114, not being required to retain the entire first and second earbud 112 and 114 in the ear, can then be fitted with less pressure in the ear which thus leads to more user comfort over a longer period of time. Overall design allows the first and second earbuds 112 and 114 to remain securely in place and sealed when user opens, closes, clenches and releases jaw, such as when talking, eating or chewing gum.

The first and second earbuds 112 and 114 positions the speaker/driver closer to the eardrum than in typical designs. This shorter distance contributes to better sound quality and lower volume setting requirements for the same perceived volume. This allows user to listen at lower volume levels that are better for their ear health, and contributes to greater autonomy of their device as it does not have to consume as much power for a similar perceived listening volume. The design of the first and second earbuds 112 and 114, with excellent acoustic sealing, close proximity of speaker/driver to users eardrum and resulting lower volume of air in the ear canal, results in less acoustical pressure being generated at the speaker/driver for a given perceived volume. This greater mechanical and acoustic efficiency translates into less electrical energy being required to drive the speaker in each of the first and second earbuds 112 and 114. This greater efficiency means less energy is consumed by the system to produce the same listening experience as competitive designs.

Figure 9C:
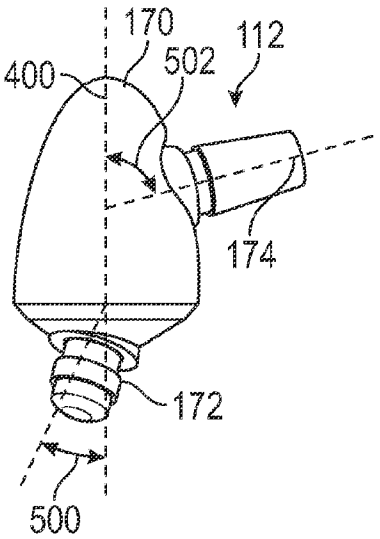
FIGS. 9A-D are perspective views illustrating the configuration of the first earbud.
Figure 9B:
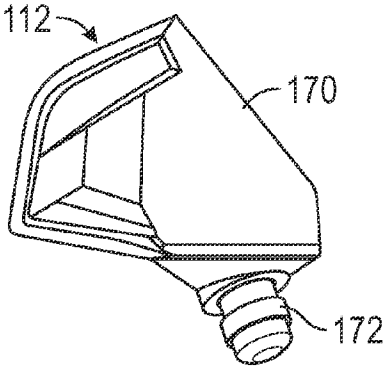
Figure 9A:
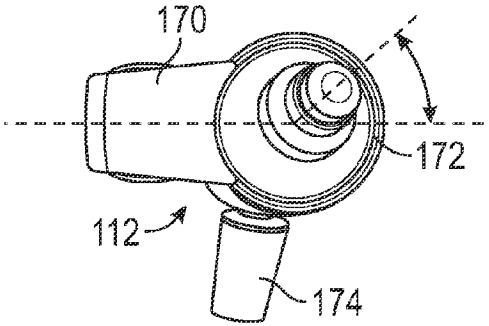
Figure 9D:
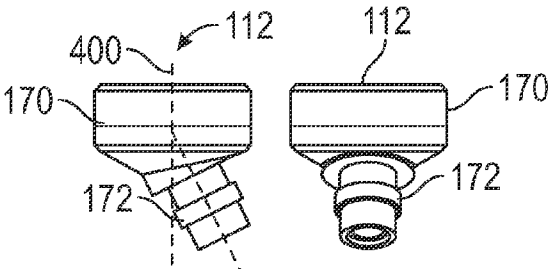

As noted above, the first and second earbuds 112 and 114 have identical configurations. Referring to FIGS. 9A-9D, by way of example, in some embodiments the first earbud 112 includes a body 170 with an eartip 172 that extends outwardly at an angle 500 relative to the longitudinal axis 400 (FIGS. 9C and 9D). In addition, the body 170 includes a connection portion 174 that extends outwardly from the body 170 at an angle 502 relative to the longitudinal axis 400. In one embodiment, angle 500 may be 20 degrees, while angle 502 may be 15 degrees.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A earphone system comprising:
a first earbud connected to a first cable;
a second earbud connected to the second cable;
a detachable electronic clasp operatively engaged to the first cable and the second cable, the detachable electronic clasp comprising:
first clasp portion, wherein the first clasp portion includes a first center section defining a first recess configured to receive a first magnet therein; and
a second clasp portion detachably connected to the first clasp portion, wherein the second clasp portion includes a second center section defining a second recess configured to receive a second magnet therein,
wherein the first magnet and the second magnet are disposed within the first and second clasp portions, respectively, to produce an attractive magnetic force between the first and second magnets that secures the first center section to the second center section;
a necklace cable operatively engaged with the electronic clasp; and
an electronic pendant in operative communication with the electronic clasp through the necklace cable for controlling the operation of the first earbud and second earbud.

2. The earphone system of claim 1, wherein the first center section defines a pair of opposing first mechanical interlocking members and the second center section defines a pair of opposing second mechanical interlocking members, wherein the pair of opposing first mechanical interlocking members is configured to engage the pair of opposing second mechanical interlocking members in a snap fit connection.

3. The earphone system of claim 2, wherein the pair of first mechanical interlocking members comprises a first outwardly extending tab and a first notch, and wherein the pair of second mechanical interlocking members comprises a second outwardly extending tab and a second notch.

4. The earphone system of claim 3, wherein the first outwardly extending tab is configured to engage the second notch and wherein the second outwardly extending tab is configured to engage the first notch.

5. The earphone system of claim 3, wherein the first notch and the second notch each form a vertical or negative angle relative to the first center section and the second center section, respectively.

6. The earphone system of claim 1, further comprising:
a first strain relief engaged to the first center section and a second strain relief engaged to the second center section, wherein the first strain relief encases a portion of the first cable and the necklace cable and the second strain relief encases a portion of the second cable and the necklace cable.

7. The earphone system of claim 1, further comprising:
a first microphone operatively connected to the first cable.

8. The earphone system of claim 7, further comprising:
a second microphone operatively connected to the second cable.

9. The earphone system of claim 1 further comprising:
a first printed circuit board operatively connected to the first center section and a second printed circuit board operatively connected to the second center section, wherein the first printed circuit board and the second printed circuit board comprise at least one of a USB data contact and a USB power contacts.

10. The earphone system of claim 1, wherein the first center section further includes a first male locator ramp and an opposing first female locator ramp, and wherein the second center section further includes a second male locator ramp and an opposing second female locator ramp, wherein the first and second male locator ramps are configured to align the first and second clasp portions when the first male locator ramp of the first center section contacts the second locator ramp of the second center section and the second male locator ramp of the second center section contacts the first female locator ramp of the first center section.

11. The earphone system of claim 1, wherein the electronic pendant comprises a controller for controlling the operation of the earphone system.

12. The earphone system of claim 1, wherein a third cable extends from the electronic pendant to an external device.

13. An earphone system comprising:
a first earbud connected to a first cable;
a second earbud connected to the second cable;
a detachable electronic clasp operatively engaged to the first cable and the second cable, the detachable electronic clasp comprising:
first clasp portion, wherein the first clasp portion includes a first center section defining a first recess configured to receive a first magnet therein; and
a second clasp portion detachably connected to the first clasp portion, wherein the second clasp portion includes a second center section defining a second recess configured to receive a second magnet therein,
wherein the first magnet and the second magnet are disposed within the first and second clasp portions, respectively, to produce an attractive magnetic force between the first and second magnets that secures the first center section to the second center section;
wherein the first center section defines a pair of opposing first mechanical interlocking members and the second center section defines a pair of opposing second mechanical interlocking members, wherein the pair of opposing first mechanical interlocking members is configured to engage the pair of opposing second mechanical interlocking members in a snap fit connection,
a necklace cable operatively engaged with the electronic clasp; and
an electronic pendant in operative communication with the electronic clasp through the necklace cable for controlling the operation of the first earbud and second earbud.

14. The earphone system of claim 13, wherein the pair of first mechanical interlocking members comprises an first outwardly extending tab and a first notch, and wherein the pair of second mechanical interlocking members comprises a second outwardly extending tab and a second notch.

15. The earphone system of claim 14, wherein the first outwardly extending tab is configured to engage the second notch and wherein the second outwardly extending tab is configured to engage the first notch.

16. The earphone system of claim 14, wherein the first notch and the second notch each form a vertical or negative angle relative to the first center section and the second center section, respectively.

* * * * *